US007507379B2

(12) United States Patent
Hunnell

(10) Patent No.: US 7,507,379 B2
(45) Date of Patent: Mar. 24, 2009

(54) UNITARY ASSEMBLY OF BIOLOGICAL SPECIMEN SUPPORT ARTICLES, AND APPARATUS FOR DISPENSING INDIVIDUAL BIOLOGICAL SPECIMEN SUPPORT ARTICLES THEREFROM

(75) Inventor: Jack E. Hunnell, Durham, NC (US)

(73) Assignee: Triangle Biomedical Sciences, Inc., Durham, NC (US)

( * ) Notice: Subject to any disclaimer, the term of this patent is extended or adjusted under 35 U.S.C. 154(b) by 1072 days.

(21) Appl. No.: 10/753,505

(22) Filed: Jan. 8, 2004

(65) Prior Publication Data

US 2005/0152809 A1 Jul. 14, 2005

(51) Int. Cl.
*B65D 85/62* (2006.01)

(52) U.S. Cl. ..... 422/102; 206/460; 206/499; 222/143

(58) Field of Classification Search ..... 422/102; 206/460, 499; 222/143
See application file for complete search history.

(56) References Cited

U.S. PATENT DOCUMENTS 3,987,901 A * 10/1976 Dullinger ..... 206/451
4,867,981 A * 9/1989 Grof ..... 424/443
5,927,497 A * 7/1999 Baumgartner et al. ..... 206/493
5,975,349 A * 11/1999 Menes ..... 221/232
6,098,839 A 8/2000 Hunnell
6,395,234 B1 5/2002 Hunnell et al.
2002/0125166 A1 * 9/2002 Laudat ..... 206/460
2003/0062375 A1 * 4/2003 Christensen et al. ..... 221/46

* cited by examiner

*Primary Examiner*—Jill Warden
*Assistant Examiner*—Paul S Hyun
(74) *Attorney, Agent, or Firm*—Steven J. Hultquist; Intellectual Property/Technology Law

(57) ABSTRACT

A unitary assembly of biological specimen support articles, arranged in a stack in which successive articles are secured in positional sequence by a tape. The tape in one embodiment is of loop form, e.g., folded back on itself with a first portion detachably adhesively secured to the stack and with the second portion back-folded over the first portion and extending beyond the stack in a free end that may be manually grasped to peel away the tape from the stack, when the stack is placed in a dispensing hopper with the free end accessed for manual grasping thereof. By stripping the tape from the stack after the stack is positioned in the dispensing hopper, the component support articles, e.g., tissue cassettes or microscope slides, are freed for subsequent dispensing and use.

21 Claims, 10 Drawing Sheets

UNITARY ASSEMBLY OF BIOLOGICAL SPECIMEN SUPPORT ARTICLES, AND APPARATUS FOR DISPENSING INDIVIDUAL BIOLOGICAL SPECIMEN SUPPORT ARTICLES THEREFROM

FIELD OF THE INVENTION

The invention relates to a unitary assembly of biological specimen support articles, e.g., tissue cassettes, microscope slides, or the like, as useful for biological specimens such as tissue samples in histological analysis or other applications such as general microscopy studies, diagnostic testing, analytical chemical studies, collection of forensic evidence, etc. The invention also relates to an apparatus for dispensing individual biological specimen support articles from a unitary assembly of such articles.

DESCRIPTION OF THE RELATED ART

In histological analysis of tissue samples and other biological specimens, the biological material after its collection is typically sectioned using cryostatic sectioning techniques of a type that are well established in the art.

For storage, transport and subsequent processing of such biological specimens (e.g., involving chemical preparation, embedding in fixing agent and sectioning for microscopic examination), the specimen may be introduced to a so-called sample cassette, e.g., a sample cassette of a type as more fully described in U.S. Pat. No. 6,395,234 issued May 28, 2002 to Jack E. Hunnell, et al. for "Sample Cassette Having Utility Histological Processing Of Tissue Samples," the disclosure of which hereby is incorporated herein by reference.

The sample cassettes used for such purpose are typically labeled so that they are readily identifiable and trackable in use. The labeling process has been automated. Various cassette-labeling machines are commercially available, including machines that are programmable for high-rate processing of sample cassettes, so that same are labeled prior to use thereof. Examples of sample cassette labeling machines include those commercialized under the trademarks SHUR/MARK® and SHUR/MARK® Plus by Triangle Biomedical Sciences (Durham, N.C., USA). An illustrative automated sample cassette-labeling device is shown and described in U.S. Pat. No. 6,098,839 issued Aug. 8, 2000 to Jack E. Hunnell for "Article Dispensing Assembly," and the disclosure of such patent hereby is incorporated herein by reference. An illustrative sample cassette article is shown and described in U.S. Pat. No. 6,395,234 issued May 28, 2002 to Jack E. Hunnell, et al. for "Sample Cassette Having Utility for Histological Processing of Tissue Samples," and the disclosure of such patent hereby is incorporated herein by reference.

In the subsequent processing of the biological specimen after its introduction to the sample cassette, the specimen is cryostatically sectioned. The tissue sections then are typically mounted on a substrate such as a microscope slide, for staining, reagent treatment, etc., and subsequent histological characterization.

Correspondingly, numerous automated systems have come into use in histology, pathology and forensics laboratories for labeling microscope slides used for mounting of sectioned tissue samples. Examples of such automated microscope slide labeling systems include the SHUR/MARK® and SHUR/Mark® Plus microscope slide labeling systems commercially available from Triangle Biomedical Sciences, Inc. (Durham, N.C., USA), the IPS slide printing system commercially available from Leica Microsystems (Bannockburn, Ill., USA) and the MicroWriter slide labeler commercially available from Raymond A. Lamb, Ltd. (East Sussex, England).

A common problem in the use of sample cassettes and microscope slides for applications involving biological samples relates to the loading of such biological specimen mounting articles into the automated labeling and dispensing apparatus in the first instance. The labeling and dispensing apparatus typically utilizes a magazine structure in which a stacked array of specimen mounting articles is positioned for subsequent successive release of individual cassette or slide articles from the magazine structure, for labeling and/or ultimate use. Such magazine structure may take the form of a channel member in which the stack of specimen mounting articles is loaded, typically in a vertical stack conformation, with the bottom-most article in the stack being positionally retained by a dispensing mechanism that is arranged to release one individual cassette or slide article at a time during the dispensing operation. The magazine structure is frequently referred to as a "hopper."

The hopper thus provides an advantage in dispensing of singular articles from a stacked array of such articles, but the hopper typically must be loaded by hand with successive articles to form the stack, or else specific packaging must be provided that is adapted to coordinate with the hopper so that articles are introduced into the hopper in a manner that facilitates subsequent dispensing.

For this purpose, the art has proposed the use of packaging containing the stacked array of specimen support articles, which is insertable into the hopper with subsequent removal of a portion of the packaging, so that the remaining packaging and stack of support articles is reposed in the hopper for subsequent dispensing.

This arrangement, however, entails the problem that packaging may be subjected to tensional and/or compressive forces during its fabrication and/or during subsequent storage, transport, and use of the package. These imposed stresses may produce a package having a squashed or otherwise dimensionally variant form, relative to the desired shape and size of the package. As a result, the misshapen packaging may render it difficult to introduce the package of specimen support articles into the hopper, in proper registration, e.g., with the dispensing mechanism.

Additionally, manufacturing tolerances on the packaging may vary and prevent a smooth fit of the packaging container in the hopper from being achieved, with the result that specimen support articles must be removed from the packaging and loaded by hand into the hopper, precisely the circumstance that is desired to be avoided by the provision of integrated packaging of the support articles.

Another problematic aspect of packaging designed to be inserted into the hopper is that the removal of the package portion, e.g., a closure flap, tear strip, or the like, to release specimen support articles from the package, may be difficult to carry out. Such difficulty relates to the fact that the packaging must be broken after the package is mounted in position in the interior channel of the hopper to effect the desired release of contained articles. This in turn requires accessing the packaging in situ in the hopper for opening thereof, and removing the package portion that would otherwise occlude the hopper channel or otherwise interfere with the subsequent dispensing operation if it were not withdrawn from the hopper.

Another deficiency involving sample cassettes is that such articles may be stacked in the hopper at an angle (see for example FIGS. 2 and 4 of the aforementioned U.S. Pat. No. 6,098,839), and therefore the packaging accommodating such angled cassettes must employ wedge-shaped inserts or obliquely-angled packaging, which significantly increases the cost, complexity, and manufacturing time associated with the packaging of the stacked array of cassettes.

The foregoing deficiencies of the prior art have adversely affected the use and efficiency of cassette and microscope slide dispensing apparatus and operations, including labeling operations associated with the dispenser.

SUMMARY OF THE INVENTION

The present invention relates generally to a unitary assembly of biological specimen support articles, e.g., tissue cassettes, microscope slides, or the like, as useful in mounting tissue samples for histological analysis or other applications such as general microscopy studies, diagnostic testing, analytical chemical studies, collection of forensic evidence, etc., as well as to an apparatus for dispensing individual biological specimen support articles from a unitary assembly of such articles.

In one aspect, the invention relates to an assembly of biological specimen support articles, wherein the support articles are arranged in a stack, with a looped tape including first strip and second strip portions, wherein the first strip portion is detachably adhesively secured to the support articles in the stack, and the second strip portion of the looped tape includes a free end, whereby the first strip portion is detachable from the stacked articles by translation of the free end of the second strip portion.

In another aspect, the invention relates to a biological specimen support article dispensing apparatus, comprising an elongate channel member, and an assembly of biological specimen support articles, wherein the support articles are arranged in a stack, with a looped tape including first strip and second strip portions, wherein the first strip portion is detachably adhesively secured to the support articles in the stack, and the second strip portion of the looped tape includes a free end, whereby the first strip portion is detachable from the stacked articles by translation of the free end of the second strip portion, wherein the assembly of biological specimen support articles is disposed in the interior volume of the elongate channel member.

In yet another aspect, the invention relates to a unitary assembly of biological specimen support articles, wherein the support articles are arranged in a stack in register with one another to form a face including side surface portions of support articles in the stack, and an elongate tape including a first portion releasably secured to the side surface portions of the articles in the stack along said face, and a second portion terminating in a free end that is translatable to remove the tape from side surface portions of the support articles in the stack.

In a still further aspect, the invention relates to an assembly of cassettes, wherein the cassettes are arranged in a stack, with respective openings in said cassettes in register with one another, and a retention strip member extending through the registered openings of the cassettes and extending exteriorly at opposite ends of the stack, with the extended ends of the retention strip member being positionally arranged to retain the cassettes in the stack.

Other aspects, features and advantages of the invention will be more fully apparent from the ensuing disclosure and appended claims.

DETAILED DESCRIPTION OF THE INVENTION, AND PREFERRED EMBODIMENTS THEREOF

Figure 1:
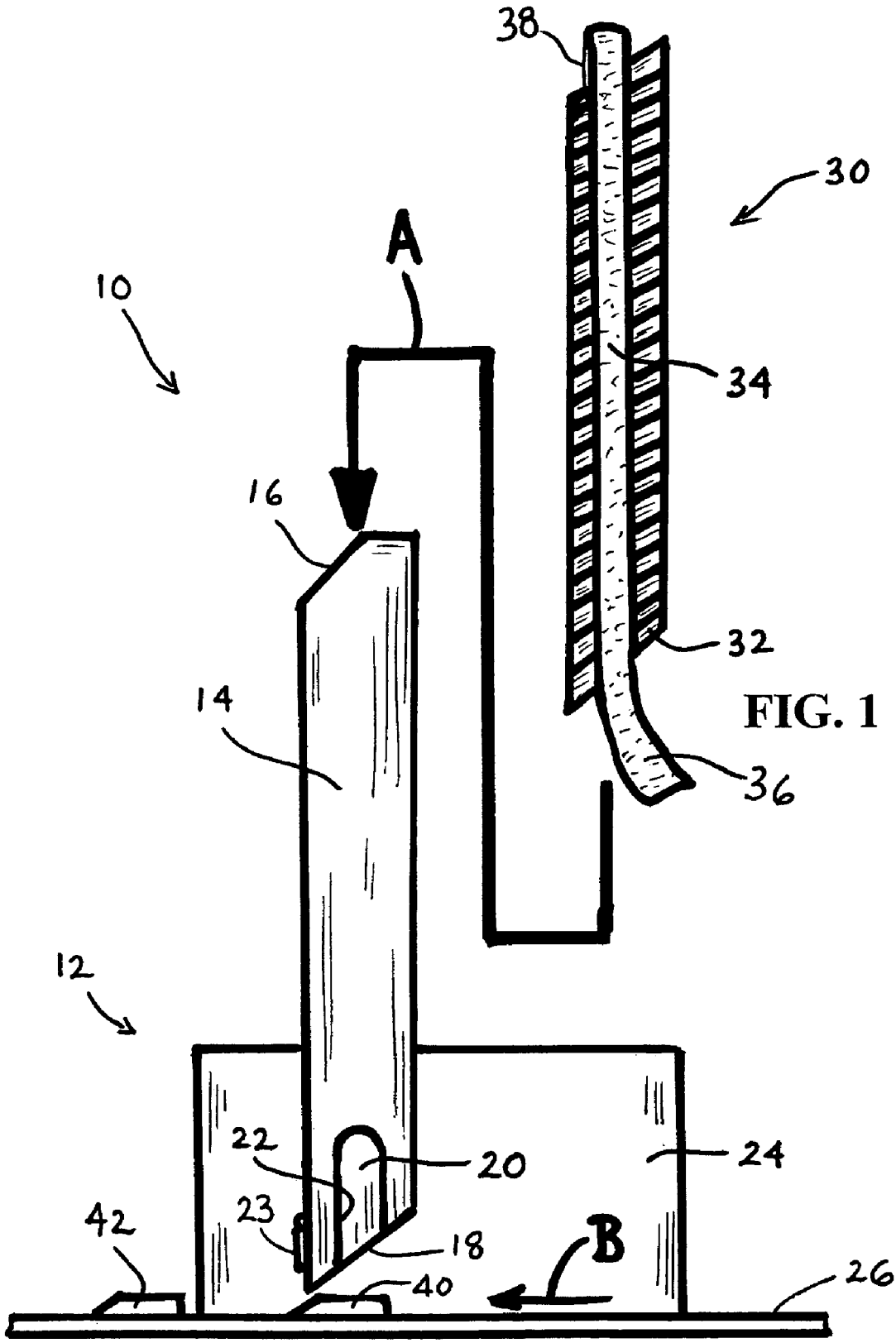
FIG. 1 is a side elevation view of a unitary assembly of biological specimen support articles, specifically sample cassettes, and an associated cassette dispenser including a hopper from which the cassette articles are individually dispensed.

The present invention provides a unitary assembly of biological specimen support articles, e.g., tissue cassettes, microscope slides, or the like, as useful for biological specimens such as tissue samples, for histological analysis or other applications, e.g., cytology research, DNA analysis, forensic studies, etc.

Although the invention is hereafter shown and described with reference to assemblies of biological specimen support articles, it will be recognized that the invention is not thus limited, but rather extends to and encompasses unitary assemblies of other articles, e.g., of a type in which individual articles are sequentially dispensed from a magazine, feed channel, or the like.

The unitary assembly of biological specimen support articles in accordance with the invention includes a stack of such support articles, in which successive adjacent articles preferably are in contiguous relationship to one another, with the articles stacked in register with one another in the unitary assembly.

A tape member is provided, including a tape strip having an adhesive face in contact with the stack so as to adherently secure each of the articles in the stack in position in the array of article(s) forming the stack. The tape strip suitably is formed to extend in a loop conformation to a free end, with the free end being manually translatable away from the stack of biological specimen support articles to remove the tape from the stack, so that the biological specimen support articles are unbound from one another, for subsequent dispensing.

Thus, in one aspect, the invention relates to an assembly of biological specimen support articles, wherein the support articles are arranged in a stack, with a looped tape including first strip and second strip portions, wherein the first strip portion is detachably adhesively secured to the support articles in the stack, and the second strip portion of the looped tape includes a free end, whereby the first strip portion is detachable from the stacked articles by translation of the free end of the second strip portion.

The looped tape may for example be formed of a cellulosic or polymeric material, with a low-tack adhesive on a face of the first strip portion in contact with the support articles in the stack.

The invention in another aspect includes a dispensing apparatus featuring a channel member operative as a hopper in which the unitary assembly of biological support articles can be installed. The channel member advantageously includes a cutout through which the free end of the tape is accessible for removal of the tape from the stack of biological specimen support articles when the unitary assembly of biological specimen support articles is disposed in the channel member.

The unitary assembly of biological specimen support articles may be constructed with the support articles arranged in a stack in register with one another to form a face including side surface portions of support articles in the stack, and an elongate tape. The tape is advantageously formed as including a first portion that is releasably secured to the side surface portions of the articles in the stack along its face, and a second portion terminating in a free end that is translatable to remove the tape from side surface portions of the support articles in the stack.

As a further alternative construction, the unitary assembly of biological specimen support articles may comprise an assembly of cassettes, wherein the cassettes are arranged in a stack, with respective openings in the cassettes in register with one another, and a retention strip member extending through the registered openings of the cassettes and extending exteriorly at opposite ends of the stack, with the extended ends of the retention strip member being positionally arranged to retain the cassettes in the stack.

By the provision of a unitary assembly of biological specimen support articles in accordance with the invention, a multiplicity of biological specimen support articles is conveniently provided in a stacked array, in a manner allowing ready removal of the tape securing individual biological specimen support articles in the array, to free the individual biological specimen support articles for subsequent dispensing.

As a result, the packaging, use and deployment of the biological specimen support articles are significantly improved, relative to the packaging and dispensing approaches of the prior art.

FIG. 1 is a side elevation view of a unitary assembly of biological specimen support articles, specifically sample cassettes, and an associated cassette dispenser including a hopper from which the cassette articles are individually dispensed.

The unitary assembly 30 of biological specimen support articles 32 is shown as including a stack of sample cassettes. Each cassette in the stack is positioned in register with the next-successive sample cassette, in contiguous relationship thereto. The cassettes in the stack are aligned with one another so as to form a side face on which the tape member 34 is disposed.

The tape member 34 is in the form of a loop in the embodiment shown, comprising a front strip with a free end 36, and a rear strip 38 that is co-extensive in length with the front strip along the side face of the stack, as shown.

The rear strip 38 has a low-tack adhesive medium on its rear face abutting the side surface of the stacked cassettes 32, so that the rear strip of tape functions to position and retain the cassettes in positional relationship to one another in the stacked conformation. The rear strip 38 of the tape extends upwardly above the stack of cassettes in the view shown, to an upper extremity. The front strip of the tape depends downwardly from such upper extremity, along the length of the stack, to a free end 36, as shown. The free end 36 may as shown extend downwardly below the stack, or otherwise may be of appropriate length, whereby the free end can be manually grasped in order to remove the tape from the stack of cassettes.

When the stack of cassettes is positioned above the open end 16 of channel member 14 of dispensing apparatus 10 (the insertion of the stack of cassettes into the elongate channel member 14 being indicated by arrow A), the unitary stack of support articles can be lowered into the interior volume of the channel member 14.

The dispensing apparatus 10 may be constructed with the channel member 14 forming a hopper affixed to the housing 12 of the dispensing apparatus, being mounted on the side face 24 of such apparatus.

The channel member 14 mounted on side surface 24 of housing 12 features a lower open end 18 communicating with a side opening 20 bounded by edge 22. The channel member is equipped with a dispensing mechanism 23 at its lower front face, so that the stack of cassettes is retained in position in the elongate channel member by the dispensing mechanism 23. In some instances, the channel member of the dispensing apparatus will be provided without an associated dispensing mechanism, in an arrangement in which cassette articles are pulled from the hopper in sequence.

Accordingly, the channel member may be formed for such purpose as simply an open chute or elongate housing member, in which the stack of cassette articles is reposed.

The dispensing mechanism 23 sequentially releases the lowermost one of the cassettes in the stack so that it drops from the channel member 14 onto the moving surface member 26, in the direction shown by arrow B. The moving surface member 26 may comprise a belt, endless loop structure, or other means by which dispensed cassettes 40, 42 are translated to a printing station (not shown in FIG. 1) for print-labeling of frontal and/or side (or other) surfaces of the cassettes with information concerning specimens and/or patients that are to be subsequently associated with the respective cassettes.

As an alternative to printing of a surface of the cassette, the cassette may be processed for labeling by affixation thereto of a paper, foil, or other label, on which is set out the relevant information concerning the specimen and/or patient.

When the unitary assembly of sample cassettes is mounted in the channel member 14 shown in FIG. 1, the free end 36 of the tape member 34 will be accessible through side opening 20 of the channel member 14.

The free end 36 then can be manually grasped, with the stack of cassettes retained in position by the dispensing mechanism 23, so that downward pulling motion on the free end 36 of the tape will cause the back surface of the rear strip of the tape to be detached from the cassettes as the tape member 34 is pulled downwardly.

The tape member 34 thereby is peeled away from the stack of cassettes so that the cassette articles are unbound and ready for individual dispensing from the channel member 14.

As an alternative to the conformation of the channel member 14 shown in FIG. 1, the channel member may be formed with a rear opening running longitudinally along the back wall of the channel member, from its bottom edge to its top edge. By such arrangement, the tape may be grasped at its free end, and drawn laterally (e.g., generally horizontally, in relation to a vertically extending stack of cassette articles) to remove the tape from the stack of cassettes.

It will be recognized that the conformation of the channel member may be substantially varied in the general practice of the invention, to accommodate removal of the tape from the stack of cassettes in various ways.

Figure 2:
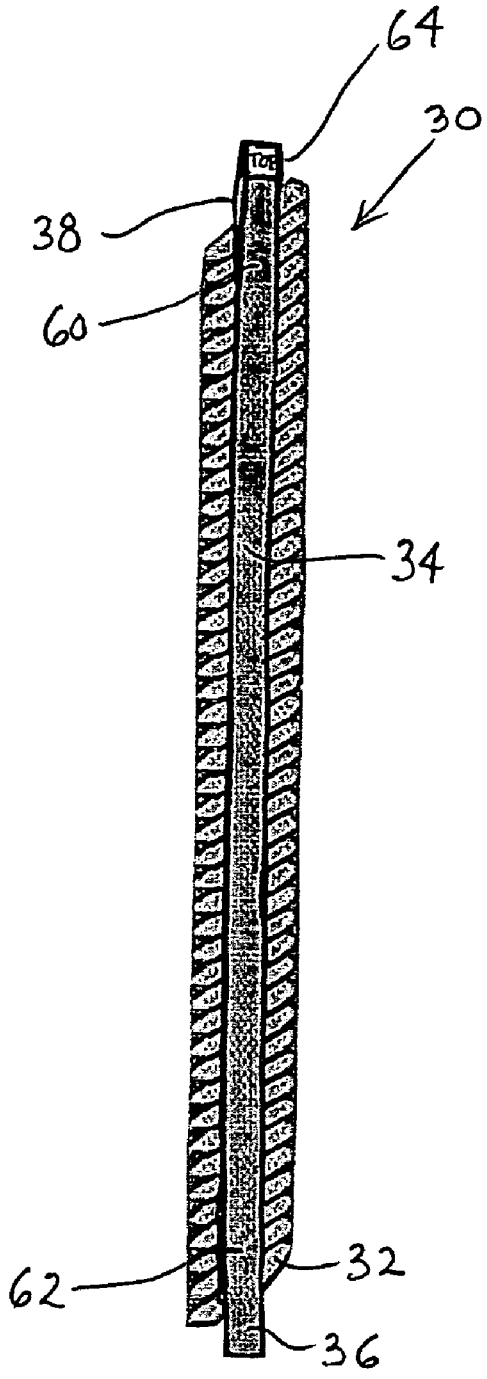
FIG. 2 is a side elevation view of a unitary assembly of sample cassette articles, of a general type as shown in FIG. 1.

FIG. 2 is a side elevation view of a unitary assembly of sample cassette articles, of a general type as shown in FIG. 1.

In FIG. 2, the unitary assembly 30 of sample cassettes 32 shown as having a rear adhesive surface of rear strip 38 of the tape member 34 in contact with the side surfaces of the stacked cassettes.

The rear strip 38 and front strip of the tape member 34 together form a loop. The looped tape in the vicinity of a juncture of the first and second strip portions may have a positional label or indicium thereon, such as the label 64 demarcating the upper extremity of the tape loop as "TOP," "TOP END," or the like, to facilitate handling and installation of the unitary assembly of cassettes. The front strip of the tape member 34 depends downwardly, to form the free end 36.

Optionally, the front strip of the tape member 34 may be locally secured to the rear strip at one or more regions or points along its length, e.g., at an upper region 60 and a lower region 62, or at any other suitable location(s). Such arrangement may be desired for the purpose of maintaining both strips of the loop in close proximity to the cassette stack, to facilitate packaging, positioning, and the like, without the looped tape becoming entangled or twisted prior to deployment of the unitary assembly of cassettes.

For such purpose, the localized affixation of the back face of the front strip to the front face of the rear strip may be effected by spot-bonding or patterned application of low tack adhesive bonding medium to areas of the facing regions of the respective strips so that they adhere to one another.

As a further alternative, the upper and lower regions of the tape member may be compression welded to one another, or in other manner be lightly affixed to one another so that the rear face of the front strip and the front face of the rear strip are in abutment with one another, in a manner permitting the strip to be efficiently peeled away from the cassette stack by downward translation of the free end 36 of the front strip.

By such arrangement, the rear strip of the tape member is detached from the associated face of the stack, so that the constituent sample cassettes are released from one another for subsequent individual dispensing.

Figure 3:
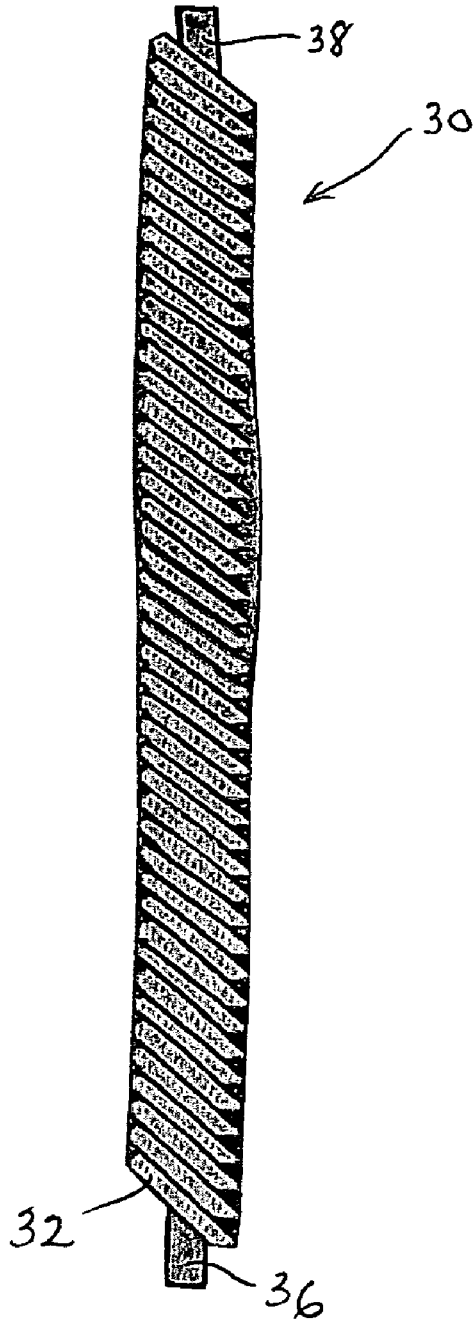
FIG. 3 is a side elevation view of a unitary assembly of sample cassette articles, viewed from a side opposite to that shown in FIG. 2.

FIG. 3 is a side elevation view of a unitary assembly of sample cassette articles, viewed from a side opposite to that shown in FIG. 2. In the view of FIG. 3, the corresponding reference numerals identify the same features and structure as in FIG. 2.

Figure 4:
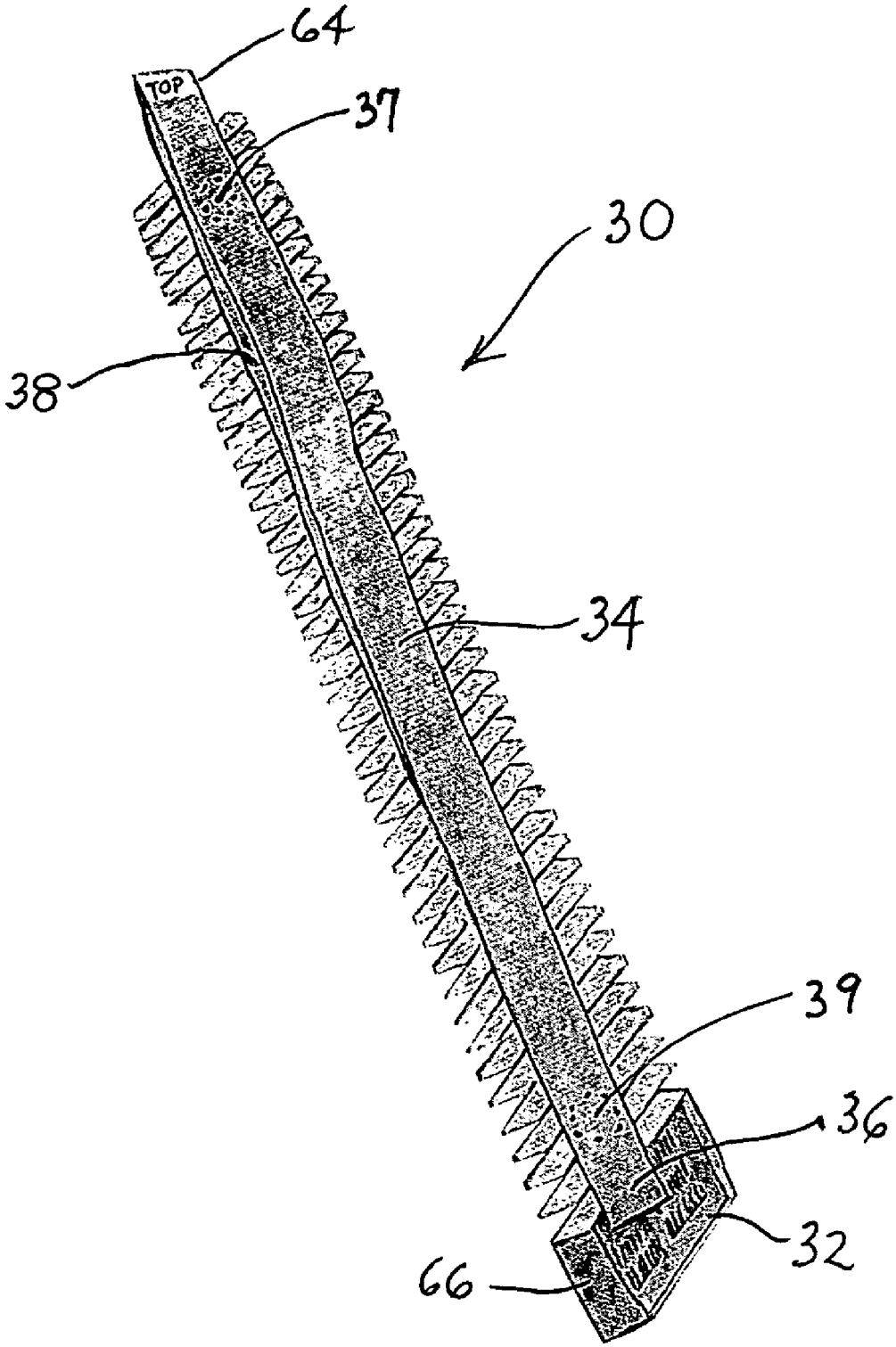
FIG. 4 is a perspective view of the unitary assembly of sample cassette articles shown in FIGS. 2-3, with the bottom cassette in the stack being turned away from the next-succeeding cassette, to show the details of the cassette structure.

FIG. 4 is a perspective view of the unitary assembly of sample cassette articles shown in FIGS. 2-3. As shown in the perspective view of FIG. 4, the bottom cassette 32 in the stack is oriented with its front face 66 shown as the surface on which information may be printed or labels may be attached. It will be appreciated that the bottom cassette in the stack shown in FIG. 4 has been rotated in relation to the next-adjacent cassette in the stack, to show the details of the cassette structure.

The front face 66 of the cassette may for example may be printed with a patient's name, patient number, tissue sample number, identification of a biopsy procedure or other tissue analysis operation, bar code, or other indicia for identification and tracking of the biological sample contained by the sample cassette in subsequent processing and characterization of the sample. The cassette may be printed or labeled in any suitable manner, and with any appropriate information, as necessary or desirable in a specific application of the invention.

The front strip and rear strip 38 of looped tape member 34 may be lightly secured to one another at top region 37 and bottom region 39 (shown by dashed-line representation), demarcating respective areas over which low-tack adhesive may be applied, or ultrasonic welding may be conducted, or other affixation method may be effected. In use, the grasping of the free end 36 of the tape member 34 and downward pulling of same by a user will dislodge or break the adhesive seal at region 39 and subsequently at region 37. Thereafter, continued downward pulling on the free end of the tape member exerts downward force on the upper end of rear strip 38 so that it is successively peeled down from the stack of cassette articles, to disengage the tape member 34 from the cassette stack. The front strip and rear strip of the looped tape member may be lightly tack-welded, bonded or otherwise adhered to one another in a manner by which the front strip is readily detachable or separable from the rear strip.

Figure 5:
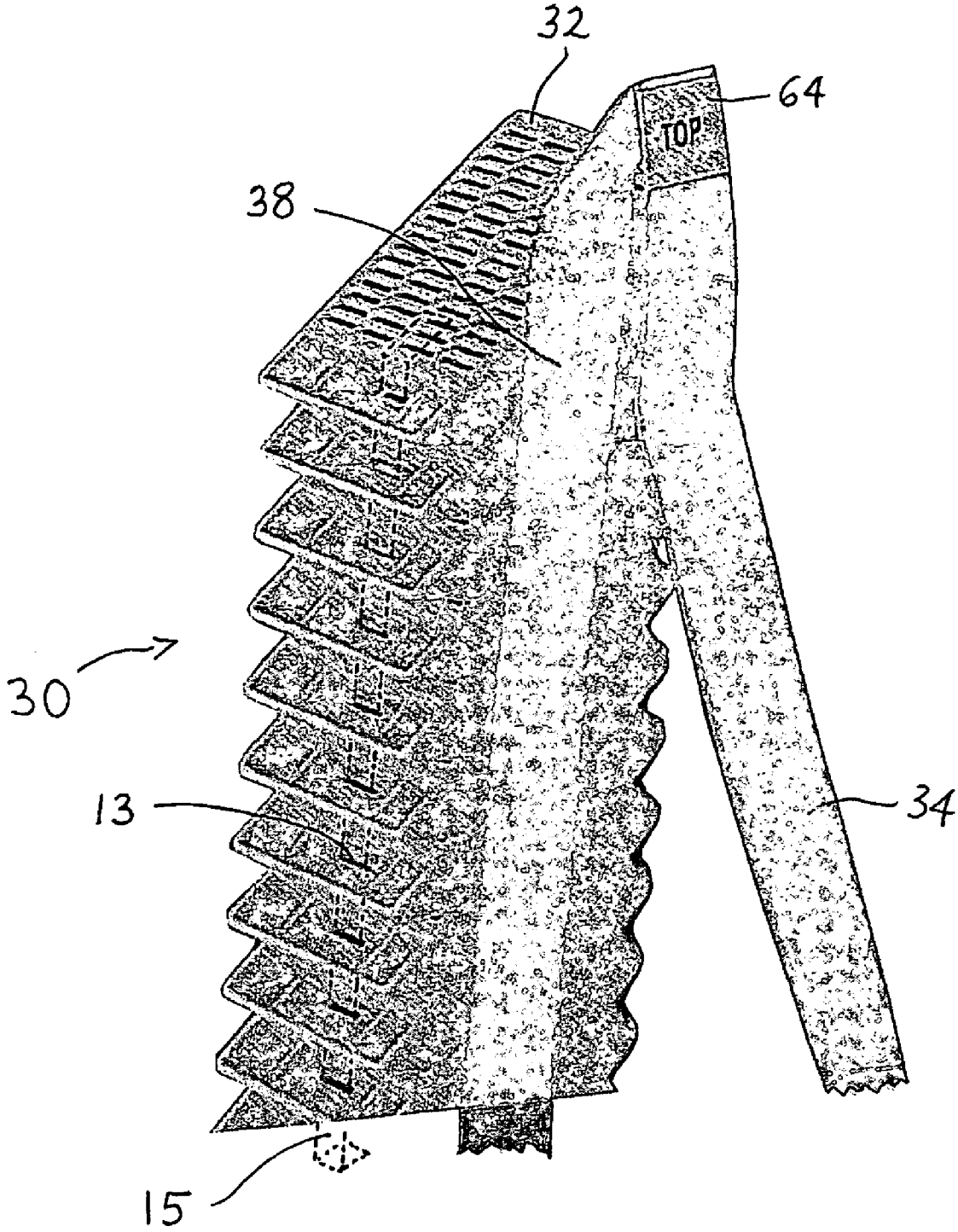
FIG. 5 is a perspective view of a top end portion of a unitary assembly of sample cassette articles in accordance with the invention, showing the details of the removable tape associated therewith. Also shown in FIG. 5 is a variant structural arrangement, wherein a retention strip is utilized and extends through registered openings, instead of the looped tape.

FIG. 5 is a perspective view of a top end portion of a unitary assembly of sample cassette articles in accordance with the invention, showing the details of the removable tape associated therewith.

The respective elements and features of the unitary assembly shown in FIG. 5 are numbered correspondingly with respect to similar features and structure in the preceding drawings.

The unitary assembly 30 includes a stacked array of cassettes 32 which are arranged in register with one another. An adhesive face of the rear strip 38 of the tape member 34 is in contact with the respective side surface portions of the successive cassettes, so that the cassettes are retained in register with one another in the stack.

As illustrated, the rear strip 38 and the front strip of the tape constitute a loop that at the upper portion bears a top-demarcating label 64 as shown. It therefore is seen that when downward pulling force is exerted on front strip of the tape, the rear strip 38 will be downwardly peeled away from the successive cassettes in the stack, until the tape has been fully pulled away from the stack.

As another modification, the cassettes in the stack of cassettes 32 shown in FIG. 5 are in register with one another. Each of the cassette articles has a slot opening 13, and the slots of the cassettes in the stack are in register with one another.

Instead of the looped tape 34 shown as a retention element for the cassettes in the stack, a strip member 15 may be inserted through each of the registered openings 13 of the successive cassettes in the stack, with respective ends being crimped over, or otherwise positionally displaced, secured, or disposed, to permit the cassettes to be maintained in a stacked conformation.

For such purpose, the strip member 15 may be formed of a semi-rigid material, e.g., a wire-reinforced ribbon, permitting ready threading of the strip through the registered openings 13, and crimping or folding of the ends, so that the cassettes are positionally retained in the stack array. Subsequently, when the cassette stack is installed in the dispensing apparatus, the strip 15 can be uncrimped or otherwise appropriately positioned for removal, followed by pulling on one end of the strip to permit extraction of the strip from the stack, so that the cassettes are released for individual dispensing.

Figure 6:
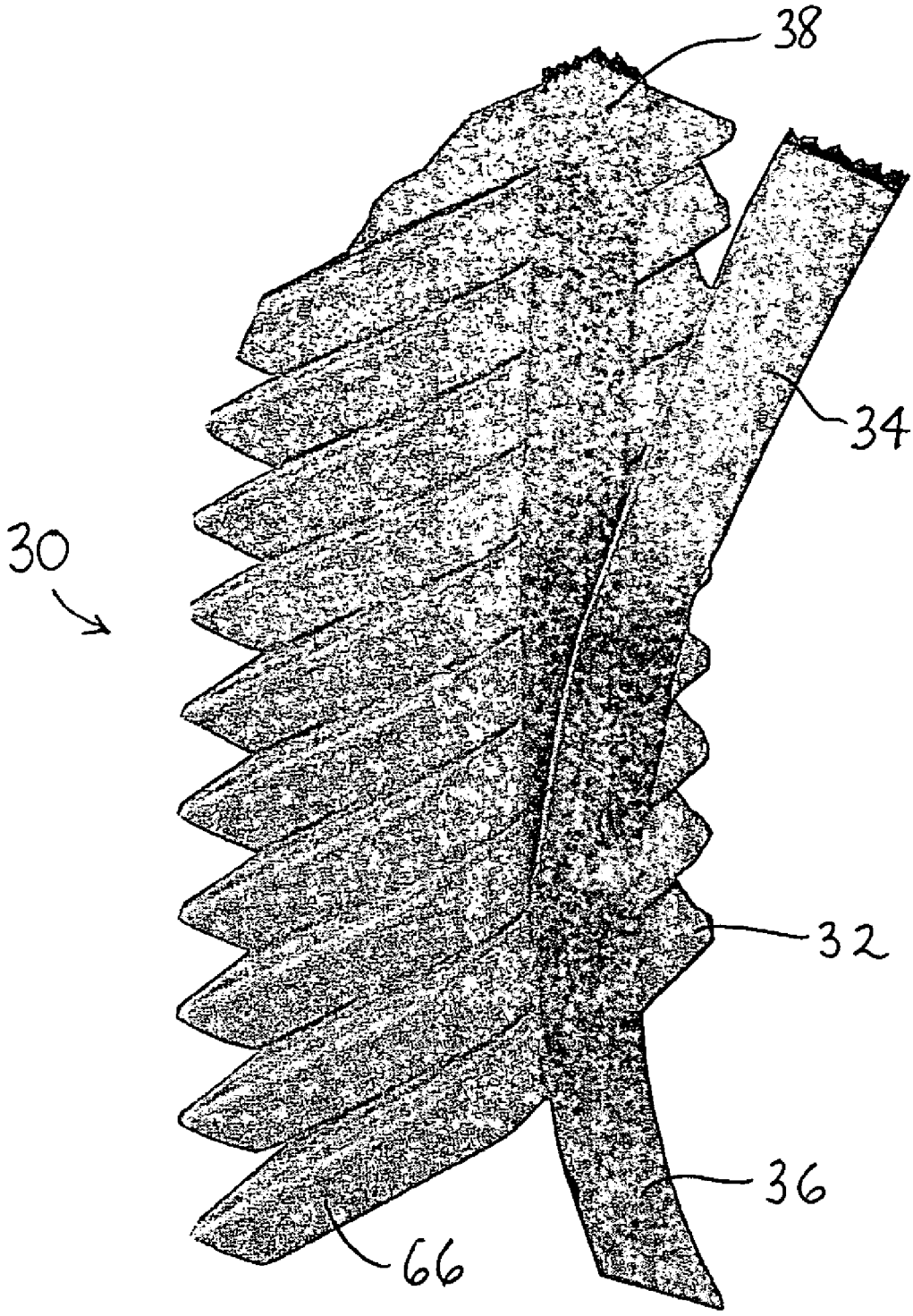
FIG. 6 is a perspective view of a bottom end portion of the unitary assembly of biological specimen support articles in accordance with the invention, showing the details of the removable tape.

FIG. 6 is a perspective view of a bottom end portion of the unitary assembly 30 of biological specimen support articles 32 in accordance with the invention, showing the details of the removable tape. The structure in FIG. 6 is numbered correspondingly with respect to preceding drawing as regards corresponding component features and structure thereof.

As shown, the unitary assembly 30 of cassettes 32 is arranged so that the face 66 of each of the cassettes is shown in the drawing, with the stack having a side face formed by respective side surfaces of the constituent cassettes. On this face of the stack of cassette articles is attached the rear strip 38 of the tape. The front strip of the tape 34 as shown may be positioned over the lower end portion of rear strip 38 at the bottom part of the stack, and with the front strip downwardly extending below the stack to form the free end 36.

It will therefore be seen by viewing of the top portion in FIG. 5 and bottom portion in FIG. 6 that the vertically stacked cassettes define an arrangement by which the free end of the tape may be readily grasped and pulled away from the stacked assemblage of cassette articles to disengage the tape therefrom and allow the freed cassettes to be dispensed in individual successive fashion.

Figure 7:
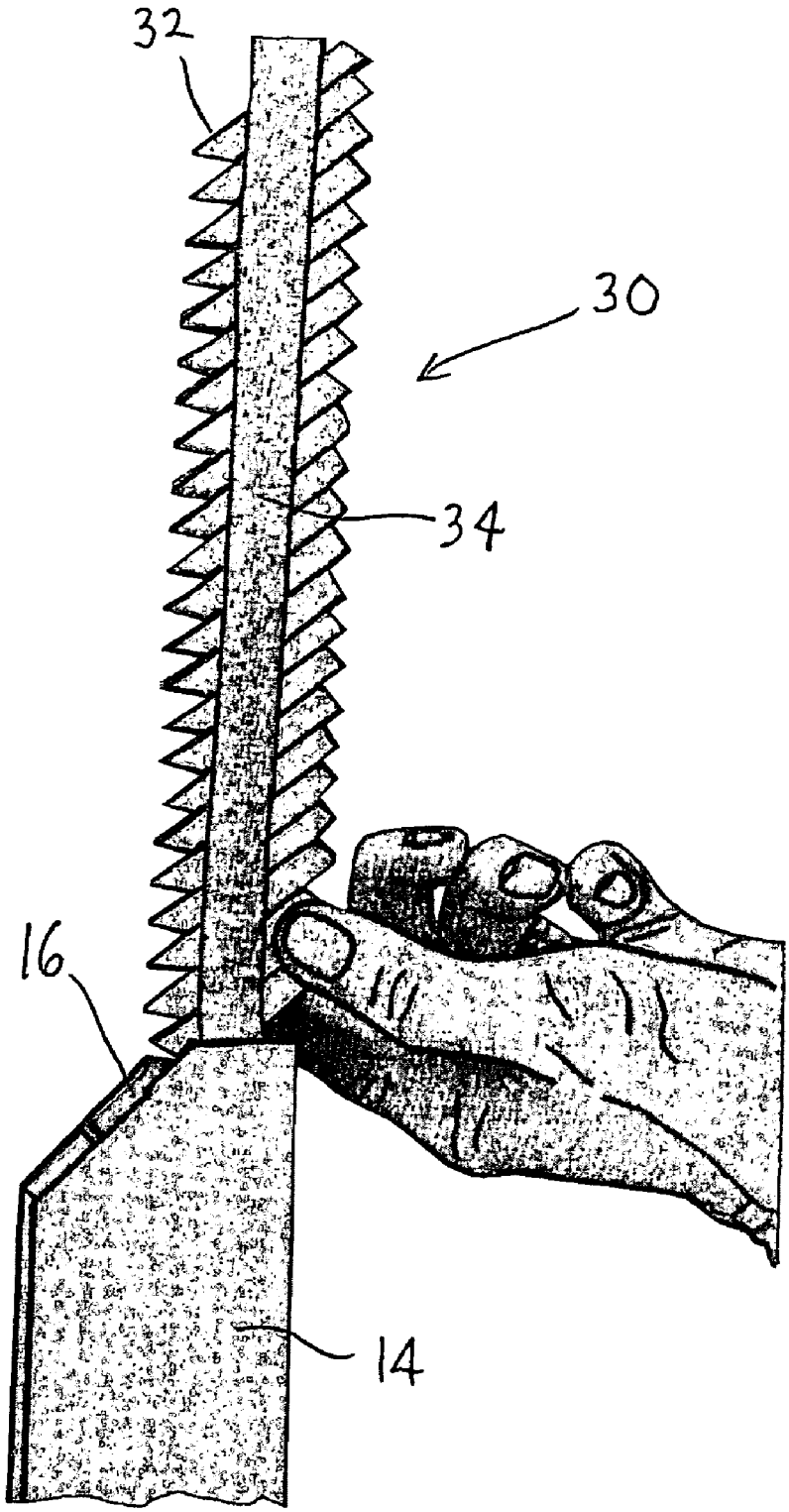
FIG. 7 is an elevation view of the installation of a unitary assembly of sample cassette articles in a dispensing hopper.

FIG. 7 is an elevation view of the installation of a unitary assembly of sample cassette articles in a dispensing hopper.

As illustrated, in the unitary assembly 30, the cassette articles 32 are positionally retained in a stacked conformation by tape 34. The cassette stack is manually downwardly inserted through the top opening 16 of channel member 14 to position the entire stack of cassette articles in the interior volume of the channel member.

Figure 8:
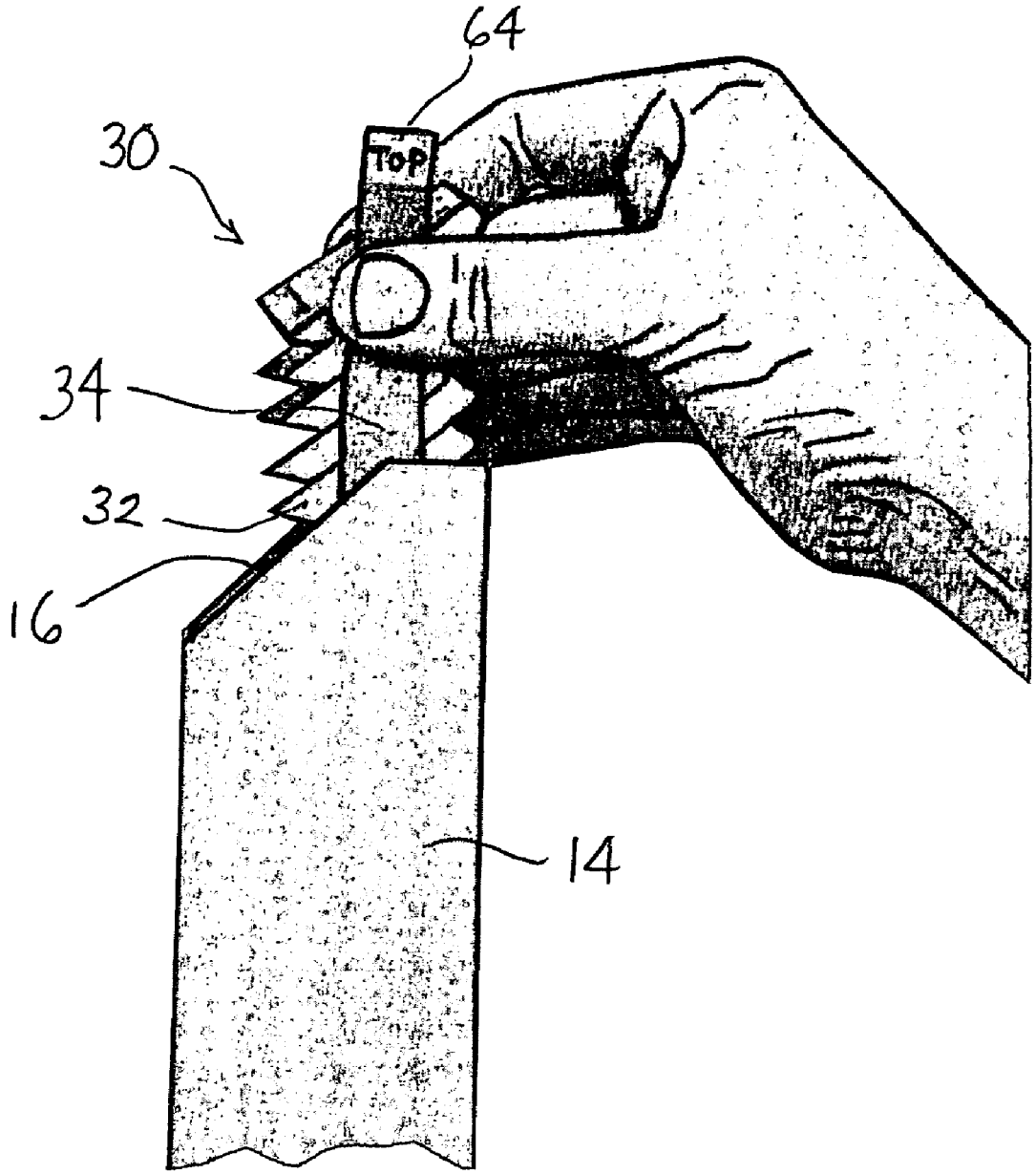
FIG. 8 is an elevation view of the further insertion of the unitary assembly of sample cassette articles into the hopper, subsequent to the initiation of the insertion operation shown in FIG. 7.

FIG. 8 is an elevation view of the further insertion of the unitary assembly of sample cassette articles into the hopper, subsequent to the initiation of the insertion operation shown in FIG. 7.

In this subsequent (time-elapsed view), the unitary assembly 30 of cassette articles 32 has been lowered almost completely into the channel member 14, with the top portion of the tape bearing the positional label 64. It will be appreciated that the positional label 64 is an optional feature of the unitary assembly of cassette articles, and may be absent from the looped tape, if desired.

Figure 9:
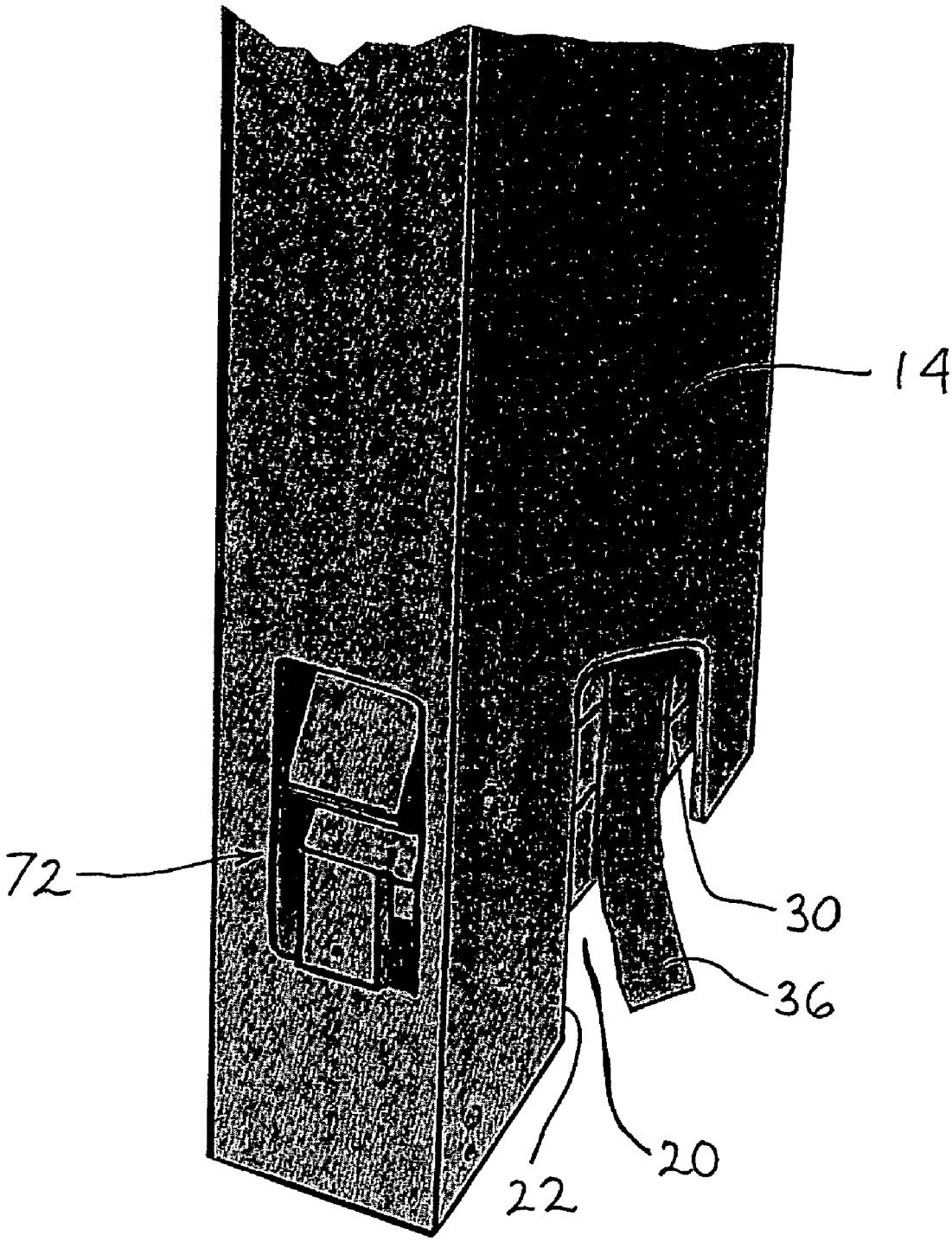
FIG. 9 is a perspective view of the hopper of FIGS. 7-8, showing the unitary assembly of sample cassette articles disposed therein, and ready for detachment of the tape from the stacked array of cassettes.

FIG. 9 is a perspective view of the hopper of FIGS. 7-8, showing a unitary assembly of sample cassette articles disposed therein, and ready for detachment of the tape from the stacked array of cassettes.

As illustrated, the channel member 14 is equipped with dispensing mechanism 72 that retains the stacked cassettes in position for individual dispensing. It will be appreciated that the dispensing mechanism 72 may be absent from the channel member in specific embodiments of the invention, such as in dispensing assemblies in which the cassette articles are pulled from the channel member in the dispensing operation.

In the view shown, the unitary assembly 30 of cassettes has been lowered downwardly in the channel member 14 so that the lowermost cassette in the stack is engaged with the dispensing mechanism 72, and the unitary assembly is in position for detachment of the tape therefrom.

The free end 36 of the tape is shown protruding through the opening of 20 bounded by edge 22. Such arrangement facilitates ready grasping of the free end of the tape by a user, so that the tape then can be drawn downwardly to disengage the adhesive face of the rear strip of the tape from the stack of cassettes. The cassettes thereby are freed from the tape and placed into condition for subsequent individual dispensing.

By the arrangement shown in FIG. 9, the tape may be drawn fully downwardly to strip it away from the stack of cassettes, and the tape thereafter may simply be discarded.

It will be seen that the array of stacked cassettes is constituted by the securing tape as a unitary assemblage that may be handled, packaged, transported, and deployed for use in such unitary form, with the tape being readily strippable from the stacked array to release the cassettes for subsequent dispensing.

It will therefore be appreciated that the tape may in some instances obviate the need for any further packaging, so that multiple stacks of cassette articles, each positionally secured in unitary conformation by a looped tape in the manner described, may be placed in a single shipping container without the need for individual packaging or packaging of multiple cassettes in loose fashion in a box or other container.

It will also be appreciated that the cost of forming unitary assemblies of cassette articles in accordance with the present invention is substantially reduced in relation to prior art packaging approaches.

Additionally, the unitary assemblies of the present invention can be readily deployed, in a much shorter time than is required for manually loading a hopper of a cassette dispensing apparatus with individual cassette articles.

The looped tape after its removal from the stacked assembly of cassette articles can be readily discarded, with much less waste material being generated in relation to packaging of the prior art.

Figure 10:
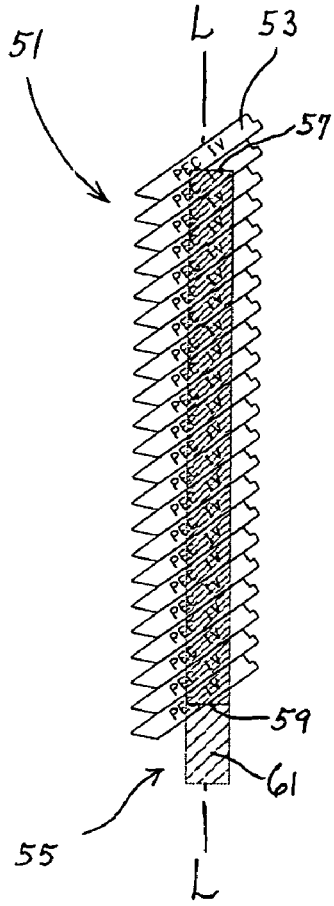
FIG. 10 is a side elevation view of a stack of sample cassettes featuring a looped tape securement member, according to one embodiment of the invention.

FIG. 10 is a side elevation view of a stack of sample cassettes featuring a looped securement tape, according to one embodiment of the invention.

The assembly 51 of cassette articles 53 shown in FIG. 10 embodiment features the cassette articles disposed at an angle with respect to the longitudinal axis L-L, with the securement tape 55 being aligned in a generally parallel manner to the longitudinal axis L-L.

The securement tape 55 includes a tape loop formed by superposed layers that are coextensive from the top end 57 of the tape loop to the bottom end 59 of the portion of the tape loop that is adjacent the face of the cassette stack. The front over-folded strip extends downwardly below the bottom end 59 of the first portion of the tape loop, forming the free end 61, as illustrated.

In this manner, the stacked cassette articles 53 form a side face of the stack on which the tape is secured, to positionally retain the successive cassette articles in sequence in the stacked array. The strip adjacent the stacked array has on its face contacting the array a low-tack adhesive material that is sufficiently strong to secure the stack with the successive cassettes in sequence, but having peel characteristics permitting the tape to be readily stripped away from the stack by downward manual force exerted on the free end 61 of the looped securement tape 55.

Figure 11:
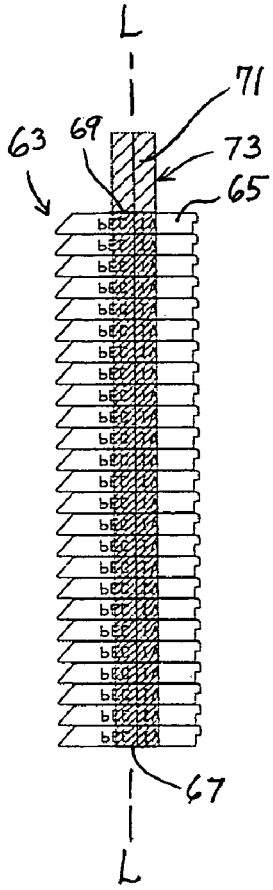
FIG. 11 is a side elevation view of a stacked array of tissue cassettes according to another embodiment of the invention, featuring a top-pull looped tape.

FIG. 11 is a side elevation view of a stacked array of tissue cassettes according to another embodiment of the invention, featuring a top-pull looped tape.

In contrast to the stack of cassette articles shown in FIG. 10, the stack in FIG. 11 is arranged with the respective cassettes aligned perpendicularly in relation to the longitudinal axis L-L of the stack. The stack 63 of cassette articles 65 thus provides a side face on which the securement tape 73 is secured along the length of the stack, from a bottom extremity 67 of the tape loop at the juncture of the front and rear strip portions thereof, to top end 69. The inner (back) strip portion of the tape loop terminates at such top end 69, while the outer (front) strip portion of the tape loop extends vertically upwardly, forming a free end 71.

It will be recognized that the front strip portion of the tape loop may extend, as illustrated, above the stack. In other embodiments, the free end may terminate at an elevation adjacent top end 69 of the tape loop. In all instances, the free end may be disposed at a position rendering it susceptible to ready access for removal of the loop tape from the stack of articles in the assembly.

When the free end 71 of the tape loop is drawn upwardly to release the cassettes, in the configuration shown in FIG. 11, it may be necessary to restrain the stack in position by placement of a finger on the top cassette element in the stack, or in other manner restrain the stack against upward movement, so that the looped tape is cleanly detached from the stack. In other arrangements where the tape is pulled downwardly or laterally, the weight of the stack will serve to maintain it positionally in the hopper.

Figure 12:
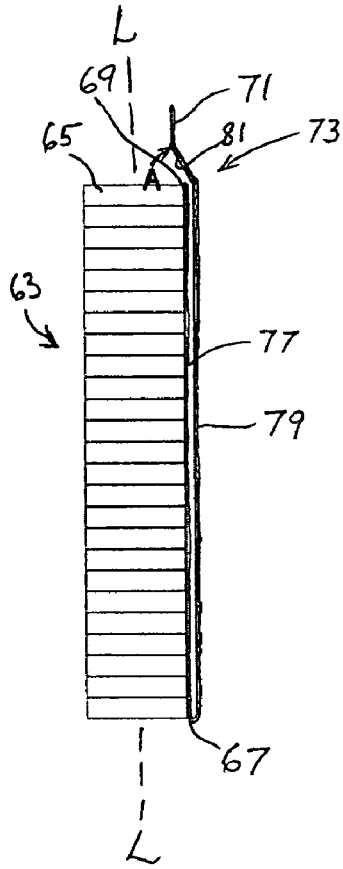
FIG. 12 is a front elevation view, showing the FIG. 11 assembly of cassette articles, and the details of the looped tape securement member.

FIG. 12 is a front elevation view, showing the FIG. 11 assembly of cassette articles, and the details of the looped tape securement member.

The features and constituent elements of FIG. 11 are numbered correspondingly in FIG. 12, for ease of reference.

As shown, the vertically extending stack 63 of cassette articles 65 at its right-hand surface in the view in FIG. 12 has inner strip 77 of the looped securement tape 73 secured thereto, and the outer strip 79 extends from the bottom extremity 67 upwardly along the stack to the free end 71.

In such manner, the inner and outer strips are coextensive along their lengths from the bottom extremity 67 to the top end 69 of the inner strip of the looped tape. The free end 71 of the looped tape on its interior surface 81 has a low-tack adhesive applied thereto.

In the FIG. 11 arrangement, the tissue cassettes are stacked with their main top and bottom surfaces in perpendicular relationship to the longitudinal axis L-L of the stack. The tissue cassettes are stacked with their respective side surfaces in register with one another, to form a flat face of the stack on which the first strip portion of the looped tape 73 is secured.

The low-tack adhesive on the interior surface 81 may be the same as, or different from, the low-tack adhesive on the inner face of inner strip 77 of the looped tape. This low-tack adhesive may be applied over the portion of free end 71 extending above the stack 63 up to point A. The low-tack adhesive may for example be selected from acrylic adhesives, silicone adhesives, rubber cement adhesives, vinyl alcohol adhesives, butadiene-styrene adhesives, and epoxy adhesives.

By the arrangement shown in FIGS. 11 and 12, the adhesive-bearing portion of the free end may be folded down to secure the outer strip of the tape on the top surface of the stack, with the un-bonded portion of the free end thereby serving as a pull tab. The pull tab (i.e., the un-bonded portion of the free end) may be pulled to release the full extent of the free end 71. Once thus freed along its full length, the free end can be pulled upwardly to remove the tape loop from the assembly of stacked cassettes.

The embodiment of FIGS. 11 and 12, in contrast to that of FIG. 10, is stripped away by application of upward force on the free end 71 of the looped tape, whereby the tape is stripped from the cassette stack in a "bottom up" fashion rather than an "top down" manner as is characteristic of the FIG. 10 embodiment.

It will be recognized from the embodiments of FIGS. 10-12 that the securement tape may be arranged in any relative orientation that is suitable for positional fixing as the component specimen support articles in the array and that enables the securement tape to be readily removable from the array, by force exerted on the free end of the looped tape. The tape may be advantageously arranged with a second portion of the tape folded back on a first portion of the tape, with a free end of the second portion extending beyond the stacked assembly of biological specimen support articles.

It will be further appreciated that while the invention has been disclosed hereinabove in reference to tissue cassettes, and hereafter in reference to microscope slides, the invention is not thus limited, but extends to and encompasses other articles of varied character, as may be utilized for histology, pathology or other applications to characterize or otherwise analyze biological specimens of widely varying types.

Figure 13:
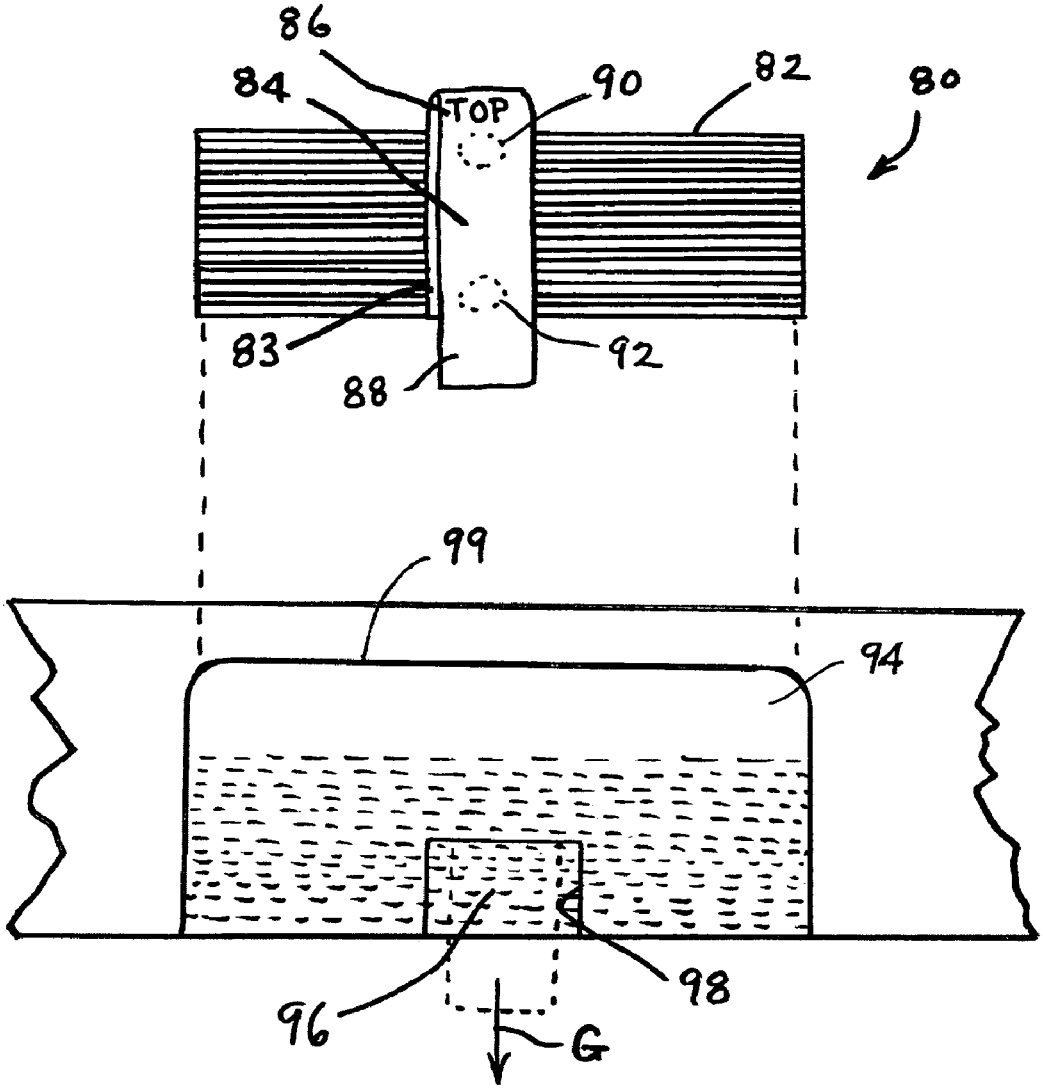
FIG. 13 is an elevation view of a unitary assembly of microscope slides in accordance with another embodiment of the invention, shown in exploded relationship to a hopper of the dispensing apparatus in which the unitary assembly is installed for removal of the retention tape, and subsequent dispensing of individual microscope slides.

FIG. 13 is an elevation view of a unitary assembly of microscope slides in accordance with another embodiment of the invention, shown in exploded relationship to a hopper of the dispensing apparatus in which the unitary assembly is installed for removal of the retention tape, and subsequent dispensing of individual microscope slides.

A stacked assembly 80 of glass microscope slides 82 is shown, in which the microscope slides are positionally secured in stacked conformation by a looped tape including a rear strip with a rear adhesive face that is secured to the stack of microscope slides, with the top portion of the loop including a positioning label 86 as illustrated. The front strip 84 of the looped tape extends downwardly below the stack of slides to a free end 88 that is manually graspable and pulled downwardly to draw the looped tape away from the stacked array of microscope slides.

The front strip 84 and rear strip 83 of the tape may be spot-bonded to one another at upper region 90 and lower region 92, with such spot bonding being of a low-tack character, whereby the seals may be broken on draw-down of free end 88. Alternatively, the spot bonding may be absent, so that the front strip is simply a folded-down length of the looped tape, which can be downwardly pulled to release the tape from the stacked microscope slides.

The FIG. 13 unitary assembly 80 of microscope slides is shown as being insertable into hopper 94 at open upper end 99 thereof. The free end 88 of the tape protrudes through the opening 96 bounded by edges 98 of the hopper, so that downward pulling in the direction shown by arrow G, produces a disengagement of the looped tape of the stack of microscope slides. Such disengagement in turn permits the stack of microscope slides to repose in the hopper 94 for subsequent individual dispensing from the bottom end of the hopper.

In the FIG. 13 schematic drawing, the retention mechanism and dispensing mechanism associated with the hopper 94 have not been shown, for ease of illustration.

It will thereby be seen that the glass microscope slides depicted in FIG. 10 may be assembled and be deployed in like manner to the cassette assembly shown and described in FIGS. 1-9 hereof.

The low-tack adhesive that is employed on the tape surface that is adherently secured to the stack of biological specimen support articles can be of any suitable type.

Illustrative examples of low-tack adhesives that may be usefully employed in the broad practice of the invention include: acrylic adhesives of the type used for coating of removable foam tape or glue dots; silicone adhesives of the type utilized for pressure-sensitive tapes; rubber cement-type adhesives, low-tack vinyl alcohol adhesives, low-tack butadiene-styrene adhesives, low-tack modified epoxy adhesives, etc.

In general, any suitable adhesive medium may be employed that is adequate to provide sufficient adherence of the looped tape to the stack of biological specimen support articles, and is readily removable by pull-away of the tape by a user.

The shear, tack and peel characteristics of suitable adhesive media may be readily determined as appropriate for specific applications of the present invention, based on the disclosure herein. In some instances, a pattern of glue dots or discontinuous spots or regions of adhesive on the tape may be satisfactory in the use of looped tape members as herein described.

The tape itself may be formed of any suitable material, including sheet or web form materials, e.g., woven or non-woven in character, that are formed of any appropriate material of construction, including for example cellulosic or fibrous materials, polymeric films, composite materials, etc.

In one specific embodiment, the looped tape may be formed of a polyester film having a low-tack acrylic adhesive on one face of a strip portion thereof, in which the strip portion is equal in length to the longitudinal dimension of the stack of biological support articles.

The type of looped tape material and adhesive medium may be widely varied with in the practice of the present invention, and optimal combinations of materials may be readily determined in the skill of the art, based on the disclosure herein.

While the invention has been illustratively described herein, with respect to particular aspects, features and embodiments, it will be appreciated that the invention is not thus limited, but is susceptible of implementation involving further variations, modifications and alternative embodiments, relative to the particular aspects, features and embodiments disclosed herein. Accordingly, the invention is intended to be broadly construed and interpreted, with respect to all such variations, modifications and alternative embodiments as will suggest themselves to those of ordinary skill in the field of the invention, based on the disclosure herein, as being within the spirit and scope of the invention as hereinafter claimed.

What is claimed is:

1. An assembly of biological specimen support articles, wherein the support articles are arranged in a stack having first and second ends, with a looped tape including first strip and second strip portions, wherein the first strip portion is detachably adhesively secured to the support articles in the stack, extending along the stack from the first end to the second end thereof, and at a juncture with the second strip portion forming a loop therewith, with the second strip portion of the looped tape extending from said juncture back along the stack over the first strip portion and beyond the first end of the stack to a free end to enable manual grasping of the free end, whereby the first strip portion is detachable from the stacked articles by translation of the free end of the second strip portion away from said stack.

2. The assembly of claim 1, wherein the biological specimen support articles comprise tissue cassettes.

3. The assembly of claim 1, wherein the biological specimen support articles comprise microscope slides.

4. The assembly of claim 3, wherein said microscope slides comprise glass microscope slides.

5. The assembly of claim 1, wherein the looped tape in the vicinity of a juncture of the first and second strip portions has a positional label or indicium thereon.

6. The assembly of claim 1, wherein the looped tape is formed of a cellulosic or polymeric material, with a low-tack adhesive on a face of the first strip portion in contact with the support articles in the stack.

7. The assembly of claim 1, wherein the biological specimen support articles comprise tissue cassettes, which are stacked in angled relationship to a longitudinal axis of the stack.

8. The assembly of claim 1, wherein the biological specimen support articles comprise tissue cassettes, which are stacked with main surfaces thereof in perpendicular relationship to a longitudinal axis of the stack.

9. The assembly of claim 1, wherein the biological specimen support articles comprise tissue cassettes, stacked with their respective side surfaces in register with one another, to form a flat face of the stack on which the first strip portion of the looped tape is secured.

10. A biological specimen support article dispensing apparatus, comprising an elongate channel member, and an assembly of biological specimen support articles, wherein the support articles are arranged in a stack having first and second ends, with a looped tape including first strip and second strip portions, wherein the first strip portion is detachably adhesively secured to the support articles in the stack, extending along the stack from the first end to the second end thereof, and at a juncture with the second strip portion forming a loop therewith, with the second strip portion of the looped tape extending from said juncture back along the stack over the first strip portion and beyond the first end of the stack to a free end to enable manual grasping of the free end, whereby the first strip portion is detachable from the stacked articles by translation of the free end of the second strip portion away from said stack, wherein the assembly of biological specimen support articles is disposed in the interior volume of the elongate channel member.

11. The apparatus of claim 10, wherein said elongate channel member has an opening at a lower portion thereof permitting access to the free end of the looped tape.

12. The apparatus of claim 10, wherein the support articles comprise tissue cassettes.

13. The apparatus of claim 10, wherein the support articles comprise microscope slides.

14. The apparatus of claim 13, wherein said microscope slides comprise glass microscope slides.

15. The assembly of claim 1, wherein the loop of the first and second strip portions extends beyond the second end of the stack.

16. The assembly of claim 15, wherein the second strip portion is detachably secured to the first strip portion at one or more locations along its length.

17. The assembly of claim 15, wherein the biological specimen support articles comprise tissue cassettes.

18. The assembly of claim 15, wherein the biological specimen support articles comprise microscope slides.

19. The assembly of claim 15, wherein the tape is formed of a cellulosic or polymeric material, with a low-tack adhesive medium on a first face of the tape first portion.

20. The assembly of claim 19, wherein the low-tack adhesive medium comprises an adhesive medium selected from the group consisting of: acrylic adhesives; silicone adhesives; rubber cement adhesives; vinyl alcohol adhesives; butadiene-styrene adhesives; and epoxy adhesives.

21. The assembly of claim 15, wherein the first portion and second portion of the tape are spot-bonded or compression bonded to one another at least one localized region thereof.

* * * * *

UNITED STATES PATENT AND TRADEMARK OFFICE

CERTIFICATE OF CORRECTION

PATENT NO. : 7,507,379 B2
APPLICATION NO. : 10/753505
DATED : March 24, 2009
INVENTOR(S) : Hunnell It is certified that error appears in the above-identified patent and that said Letters Patent is hereby corrected as shown below:

On the Title page item (75), Inventors, add: "Jesse H. Hart, Durham, NC (US)."

On the Title page item (75), Inventors, add: "Mario A. Colon, Raleigh, NC (US)."

Signed and Sealed this

Thirteenth Day of July, 2010

David J. Kappos

David J. Kappos
*Director of the United States Patent and Trademark Office*